US006709630B2

(12) United States Patent
Cameron et al.

(10) Patent No.: US 6,709,630 B2
(45) Date of Patent: Mar. 23, 2004

(54) METALLURGICAL LANCE AND APPARATUS

(75) Inventors: Andrew Miller Cameron, Derbyshire (GB); Christian Juan Felderman, Worcester (GB)

(73) Assignee: The BOC Group, plc., Windlesham (GB)

( * ) Notice: Subject to any disclaimer, the term of this patent is extended or adjusted under 35 U.S.C. 154(b) by 0 days.

(21) Appl. No.: 10/307,868

(22) Filed: Dec. 2, 2002

(65) Prior Publication Data

US 2003/0122291 A1 Jul. 3, 2003

(30) Foreign Application Priority Data

Dec. 3, 2001 (GB) ..... 0128878

(51) Int. Cl.[7] ..... C21C 5/32
(52) U.S. Cl. ..... 266/225; 266/268
(58) Field of Search ..... 266/225, 268, 266/216, 217

(56) References Cited

U.S. PATENT DOCUMENTS 4,730,784 A 3/1988 Bock et al.
5,088,696 A * 2/1992 Dessar ..... 266/225
5,746,970 A * 5/1998 Bergman et al. ..... 266/225
6,322,610 B1 * 11/2001 Pavlicevic et al. ..... 266/225

FOREIGN PATENT DOCUMENTS

| | | |
|---|---|---|
| EP | 0 235 621 B1 | 7/1992 |
| EP | 0 214 902 A1 | 3/1997 |
| EP | 1 041 341 A1 | 10/2000 |
| GB | 1 227 876 | 4/1971 |
| GB | 1 446 612 | 8/1976 |
| WO | WO 00/28097 | 5/2000 |

* cited by examiner

*Primary Examiner*—Scott Kastler
(74) *Attorney, Agent, or Firm*—Joshua L. Cohen

(57) ABSTRACT

A metallurgical lance for introducing gas from above into a volume of metal in a vessel includes a head having at least one ejector formed therein. The ejector includes a Laval nozzle surrounded by a shrouding gas passage. Both the Laval nozzle and the shrouding gas passage communicate at their proximal ends with a common gas supply chamber. The shrouding gas passage communicates with the chamber via a first annular orifice member which determines the percentage split of the gas flow through the chamber between the Laval nozzle and the shrouding gas passage.

10 Claims, 5 Drawing Sheets

METALLURGICAL LANCE AND APPARATUS

BACKGROUND OF THE INVENTION

Field of the Invention

This invention relates to a metallurgical lance and a metallurgical apparatus including the lance. The metallurgical lance according to the invention is particularly suited to the introduction of oxygen or other gases from above into a bath of molten metal.

One use of the lance according to the invention is in steelmaking. Most steel is made today by blowing or injecting oxygen from above into a vessel containing molten iron. An example of such a steelmaking process is the so-called "LD" process in which oxygen is injected into the molten metal from above at high velocity. Another example is the "LD-AC" process in which oxygen is injected into the molten metal with powdered lime.

In these examples the metallurgical lance is typically capable of delivering oxygen to a steelmaking vessel capable of holding up to 300 tonnes or more of steel. Such a vessel is sometimes called a "converter". Initially, the lance is positioned from 2 to 4 meters above the level of the metal, and oxygen is blown from the lance at a relatively low velocity vertically downwards into the molten metal so as to produce a foaming slag on the surface of the melt. The resulting slag plays a key role in removing phosphorus from the molten metal. Later, the lance is lowered to within 1 m of the surface of the metal and oxygen is injected at a higher velocity which results in greater penetration of oxygen into the molten metal.

The metallurgical lance is designed to survive in a very aggressive oxidising and particle filled environment and to meet these needs, typically the lance head is made of copper, has more than one outlet orifice for oxygen, and is water cooled. Often the head of the lance has three or four outlet orifices, or more, for the injection of oxygen into the molten metal. The oxygen is typically supplied to the lance at a pressure of up to 15 bar and supersonic exit velocities greater than Mach 2 can thereby be achieved if each outlet orifice is being formed as a venturi.

Even though they are water cooled the lances have a short working life, typically lasting for some 350 to 450 heats.

High oxygen exit velocities from the lance are needed so as to achieve good penetration of the oxygen into the bath of the molten metal. As the oxygen leaves the lance at supersonic velocity it creates a suction force that draws the surrounding atmosphere into the oxygen jet. The jet therefore loses velocity as it spreads. Accordingly, the oxygen enters the molten metal with a velocity significantly lower than that at which it leaves the lance. Further, nitrogen impurity is introduced into the molten metal and can have a deleterious effect on the quality of the steel.

EP-A-1 041 341 addresses the problem of loss of oxygen velocity by proving a plurality of supersonic oxygen jets with a single flame shroud. The shroud reduces the amount by which the oxygen jets diverge before they enter the molten metal, and thereby inhibits the loss of velocity endured by the jets as they pass from the lance to the surface of the molten metal. The resulting oxygen jets are sometimes described as being "coherent" in the sense that they do not significantly diverge.

Such an arrangement does however have a number of disadvantages. Firstly, a supply of fuel to the lance is required in order to form the flame shroud. Since the lance may need to be positioned up to say, 30 meters above floor level, considerable engineering difficulties are added. Secondly, the head of the lance needs to be provided with additional passages for the fuel and an oxidant (typically oxygen) in order to support combustion of the fuel. This adds to the complexity and hence cost of the head. Thirdly, providing a common shroud for a plurality of oxygen jets, results in imperfect shrouding and an incomplete approach to obtaining perfect coherence. Analogous problems occur in other metallurgical processes which use at least one jet of oxygen or other gas supplied from above.

Other references disclose shielding or shrouding a central gas jet ejected from a metallurgical lance, but with a shrouding gas stream of ambient temperature gas. For example, GB-A-1 446 612 discloses employing a lance with an annular insert in each of its oxygen outlets. The oxygen flow is divided by the insert into a central stream and an outer annular stream. The arrangement is such that the annular stream issues from the lance with a radially outward component of velocity. The purpose of the modification to the lance is to confine damage from splashing to the annular insert which is readily replaceable.

GB-A-1 227 876 relates to a metallurgical lance provided with an acoustic resonator in the path of the gas exiting from the lance.

U.S. Pat. No. 4,730,784 relates to a gas nozzle which may form part of a metallurgical lance. The nozzle is designed so as to make it possible to vary the Mach number of the gas independently of its flow rate. To this end, the nozzle is provided with a variable throat. In one embodiment, there are no moving parts and the effective size of the throat is varied by the application to the main gas jet of a subsonic ring of gas. In this embodiment, the main gas jet expands out of a Laval nozzle.

EP-A-0 214 902 relates to a complex metallurgical lance which employs separate outlet passages communicating with a common chamber. However, the passages are not in a spatial arrangement such that gas issuing from one shrouds that issuing from the other.

WO-A-00/28097, on the other hand, relates to a lance which employs a shrouding gas to reduce the rate of attenuation of a central supersonic gas jet.

Of these references, therefore, only WO-A-00/28097 relates to a metallurgical lance which employs a shrouding gas to reduce the rate of attenuation of a central supersonic gas jet. WO-A-00/28097 does not however address the question of how to supply the gas to the central jet and the shrouding stream in a controlled manner.

SUMMARY OF THE INVENTION

According to the present invention there is provided a metallurgical lance for introducing gas from above into a volume of molten metal in a vessel, the lance including a head having at least one gas ejector formed therein, wherein the ejector or at least one of the ejectors comprises a Laval nozzle surrounded by a shrouding gas passage, both the Laval nozzle and the shrouding gas passage communicating at their proximal ends with a common gas supply chamber, wherein the shrouding gas passage communicates with the common gas chamber via a first annular orifice member.

The present invention also provides metallurgical apparatus including a metallurgical lance.

The metallurgical lance according to the present invention does not require a separate supply of shrouding gas and therefore circumvents engineering problems associated with such a supply. Each nozzle is provided with its own individual shroud. Further, the metallurgical lance according to the invention does not provide any undue manufacturing problems. The orifice member enables a predetermined proportion of the incoming gas to be diverted to the shrouding gas passage. The size, shape and number of the orifices can, for example, be selected so as to determine the proportion of the gas that is supplied from the common gas supply chamber to the shrouding gas passage. Typically this proportion is from 5% to 20% of the gas supplied to the Laval nozzle depending on its dimensions. For small nozzles, the proportion can be higher, say, up to 50%.

The shrouding gas passage may communicate with the common gas chamber via a first annular orifice plate.

The shrouding gas passage may be defined by a sleeve coaxial with the Laval nozzle. Such an arrangement facilitates manufacture of a metallurgical lance according to the invention.

The orifice plate is preferably demountably attached to the sleeve. One advantage of such an arrangement is that if it is necessary to vary the relative proportions of gas flow through the Laval nozzle and gas flow through the shrouding gas passage, this can be readily achieved by substituting the orifice plate with one having a different percentage of its annular area open; the greater the open area, the greater the proportion of gas that flows from the gas supply chamber to the shrouding gas passage. Alternatively, the metallurgical lance according to the invention may include means for varying the proportion of the annular area of the orifice plate that is open to the common gas supply chamber. For example, the lance may include a second orifice plate with a position which is adjustable relative to the first orifice plate so as to move the orifices of the second plate into and out of registration with the orifices of the first plate.

In an alternative arrangement, the orifice member is integral with the Laval nozzle. In this arrangement the orifices in the orifice member preferably overlap a solid annular plate demountably attached to the proximal end of the Laval nozzle. The degree of overlap determines the area of the orifice member that is effectively open to the common gas supply chamber, and hence the split of the gas between the Laval nozzle and the shrouding gas passage. Accordingly, this split can be selected by choosing a solid annular plate of appropriate size, and can be changed by substituting one solid annular plate for another, the solid annular plates being of different size.

In the alternative arrangement, the Laval nozzle preferably has at least two lugs which engage the wall or walls defining the shrouding gas passage with the Laval nozzle.

Preferably, the distal end of the Laval nozzle is set back relative to the distal end of the ejector. The arrangement helps to lessen any damage to the Laval nozzle that may be caused by splashing molten metal.

The lance preferably has a plurality of gas ejectors although it is possible to use a lance which has a single gas ejector.

In embodiments of the metallurgical lance according to the invention that have a plurality of gas ejectors, all the gas ejectors are preferably essentially the same as each other. The lance typically has a body which is coaxial with the head. There is preferably but a single gas passageway through the body that communicates with the common gas supply chamber. It is however possible to employ different kinds of ejector in the same lance. Thus, there may be one or more conventional ejectors in addition to an arrangement in which one or more Laval nozzles are each provided with their own shrouding gas passage.

The head of the metallurgical lance according to the invention typically has internal passages for the flow of a liquid coolant, for example water.

BRIEF DESCRIPTION OF THE DRAWINGS

Metallurgical lances according to the invention will now be described by way of example with reference to the accompanying drawings in which.

Figure 1:
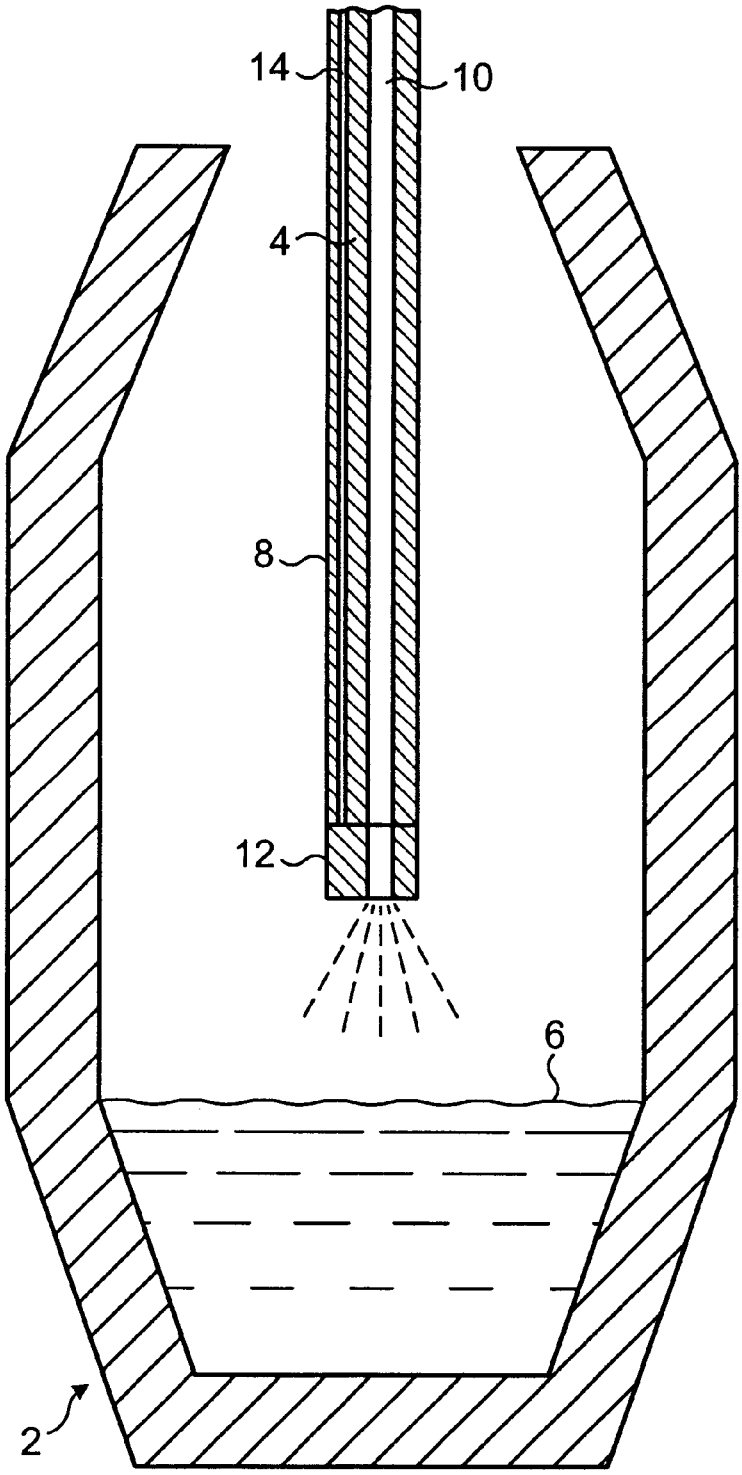
FIG. 1 is a cross section side view of an apparatus and metallurgical lance having a lance head according to the present invention.

The drawing Figures are not to scale.

DETAILED DESCRIPTION OF THE INVENTION

Referring to FIG. 1 of the drawings, there is shown generally a steelmaking vessel 2. A metallurgical lance 4 is positioned above a bath 6 of molten ferrous metal in the vessel 2. The lance is held by a support arm (not shown, but well known in the art) and is able to be raised and lowered relative to the surface of the molten metal. The mechanism for raising and lowering the arm and the metallurgy of steelmaking are well known and need not therefore be described herein.

The lance 4 has an elongate body 8 with a right cylindrical passage 10 formed therein. The passage 10 terminates at head 12 of the lance 4. The lance 4 may also have a passage or passages 14 therein for the supply of cooling water. The passages 14 also terminate at the head 12 of the lance 4.

Figure 2:
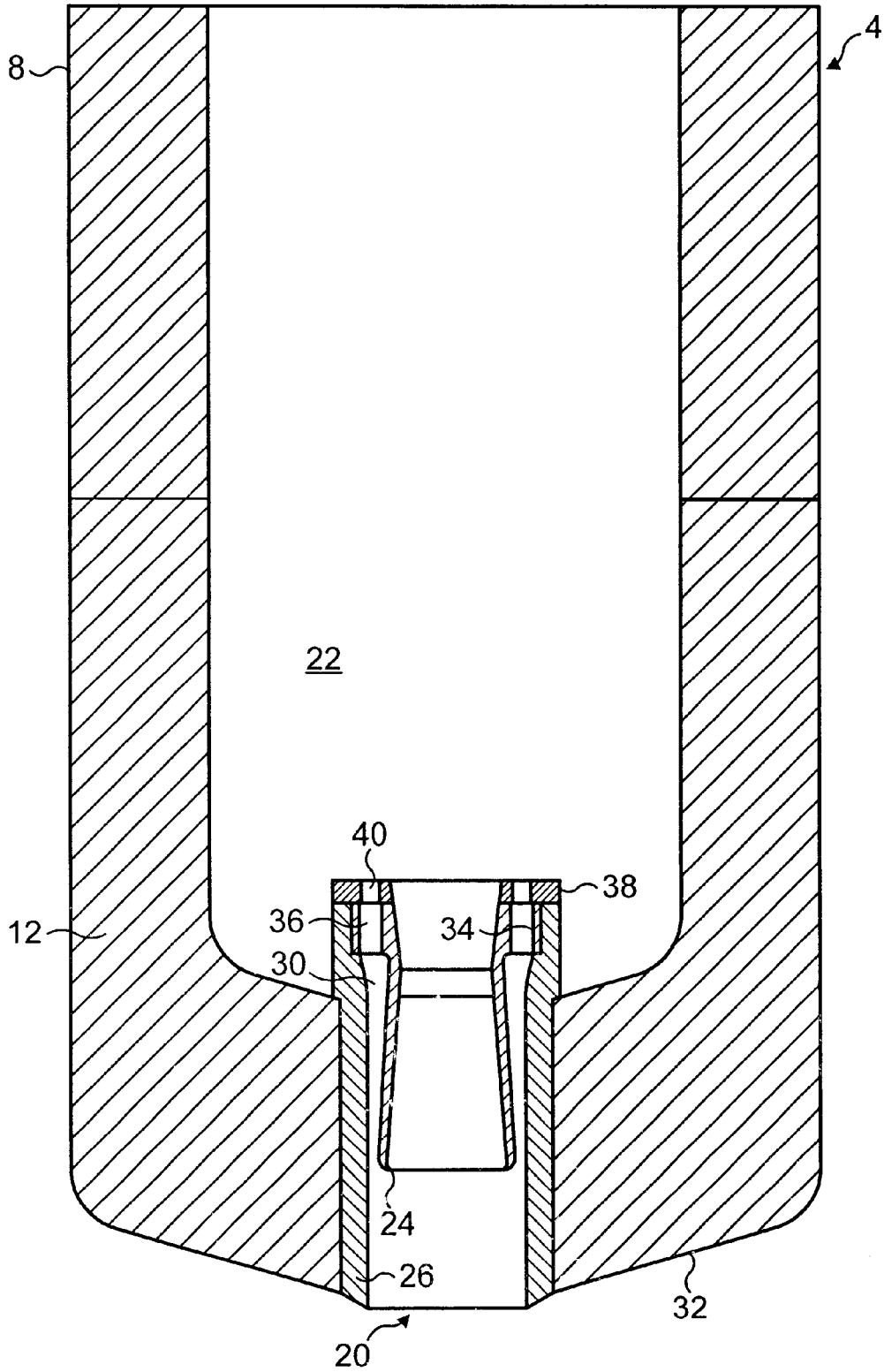
FIG. 2 is a cross sectional side elevation view of a head of the present invention with the lance shown in FIG. 1.

The head 12 of the present invention for the lance 4 is shown in more detail in FIG. 2. The head 12 has a single axial gas ejector 20 formed therein. The ejector 20 communicates at its proximal end with a gas supply chamber 22 formed in the head 12. The gas supply chamber 22 may simply be an extension of the oxygen passage 10 in the body 8 of the lance 2.

The gas ejector 20 comprises a Laval nozzle 24 which is coaxial with the longitudinal axis of the lance 4, and a sleeve 26 which surrounds the Laval nozzle 24 and which defines a shrouding gas passage 30. The sleeve 26 is also coaxial with the Laval nozzle 24 and is in frictional but gas tight engagement with a corresponding bore formed through the tip 32 of the head 12.

The Laval nozzle 24 is formed at its proximal end with a flange 34 which is in frictional but gas-tight engagement with the inner surface of the sleeve 26 at its proximal end. The flange 34 has orifices 36 therein communicating with the shrouding gas passage 30. An annular orifice plate 38 is demountably attached to the proximal end of the sleeve 26. The orifice plate 38 has a plurality of orifices 40 formed therethrough. The number, shape and size of the orifices 40 determine the proportion of gas that flows from the chamber 22, in use, to the shrouding passage 30 relative to the proportion that flows therefrom through the Laval nozzle 24.

The distal end of the Laval nozzle 24 is set back relative to the distal end of the sleeve 26. The latter protrudes slightly from the tip 32 of the head 12.

In operation of the metallurgical lance 4 to supply oxygen to a bath of molten metal, the oxygen supply pressure may be selected to be in the range of 10 to 15 bar so as to give an oxygen exit velocity from the Laval nozzle 24 of greater than Mach 2. The velocity of the oxygen through the shrouding gas passage 30 does not exceed sonic velocity and is usually less. Typically, the oxygen flow rate through the shrouding gas passage 30 is from 5% to 20% of that through the Laval nozzle 24. The oxygen exiting the shrouding gas passage 30 forms a shroud for the oxygen leaving the Laval nozzle 24. The shroud limits the amount of gas mixing that occurs at the periphery of the oxygen jet leaving the Laval nozzle in comparison with that which would occur were the shroud to be omitted and the oxygen jet to be surrounded by still air rather than by the oxygen shrouding gas flow. It is found that the amount of peripheral mixing tends to decrease as the oxygen shrouding gas flow increases from 5% of that of the supersonic oxygen jet until a maximum is reached. Thereafter further increases in the shrouding gas proportion tend to be counterproductive. The optimum shrouding gas proportion can readily be determined empirically.

Although not shown in FIG. 2, the head 12 is preferably provided with cooling passages (not shown) for the flow of a liquid coolant e.g. water. The provision of such passages is conventional in metallurgical oxygen lances, so is not described in detail herein. In order to assist in the cooling of the head, it is preferably formed of metal having a high thermal conductivity, e.g. copper.

A particular advantage of a metallurgical lance according to the invention is that it can be made by modifying a conventional lance with the head of the present invention. The existing head is removed from the conventional lance, and the head in accordance with the present invention is fitted in its place. The head may be dimensional such that the flow rate of the central oxygen jet is unaltered. As a result, taking into account the shrouding gas flow, the total oxygen flow through the lance is increased. There is therefore a need to increase the oxygen supply pressure so as to enable the additional oxygen flow to be provided. Alternatively, the total oxygen flow may remain unaltered, but this will have the effect of diminishing the central oxygen flow as some of the oxygen will be diverted to form the shroud.

Figure 3:
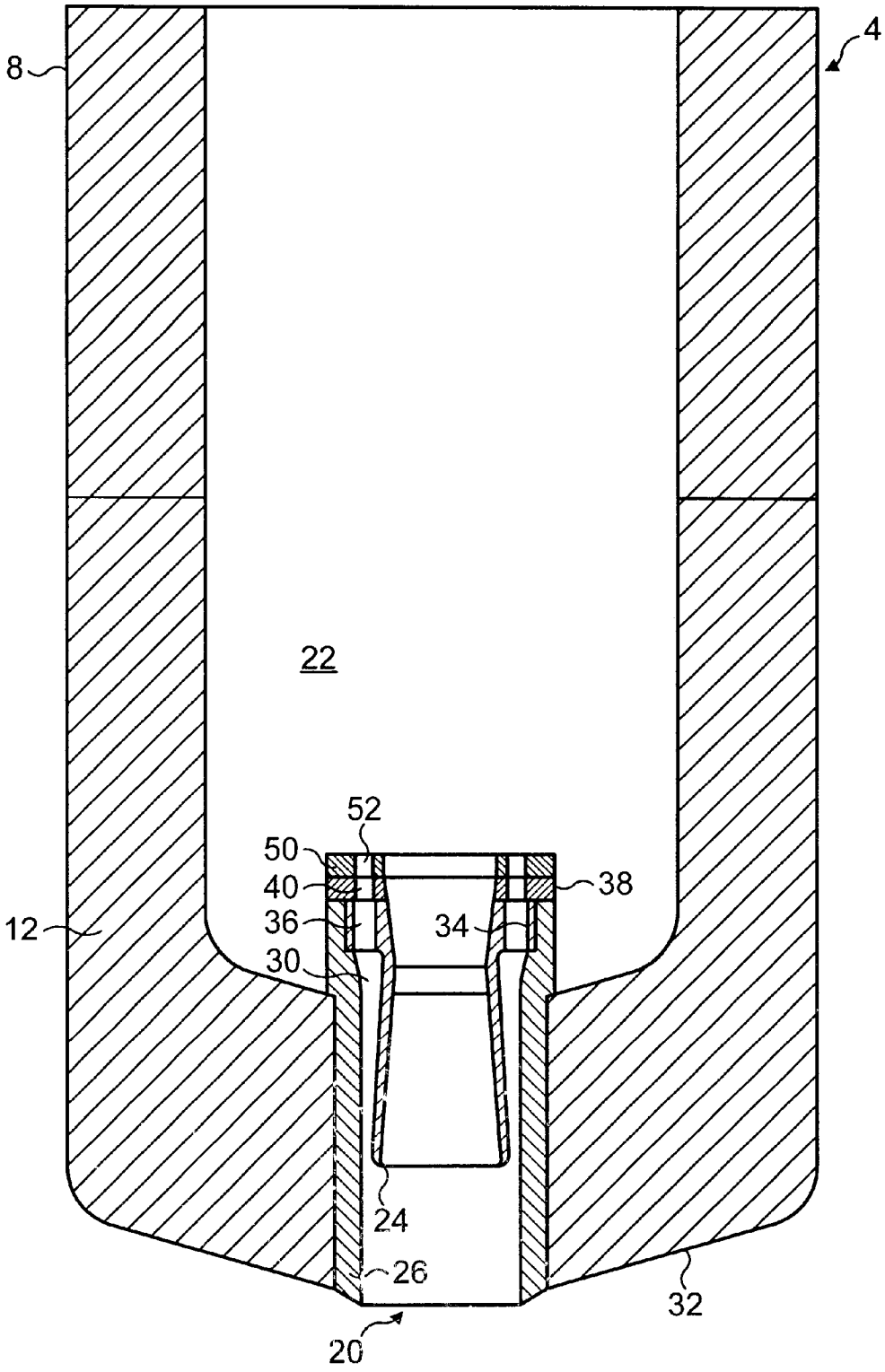
FIG. 3 is a cross sectional side elevation view of another embodiment of the head.

Another embodiment of the head 12 of FIG. 2 is illustrated in FIG. 3. The head 12 shown in FIG. 3 is provided with a second annular orifice plate 50 having orifices 52 formed therethrough. The plate 50 may be rotated, say, clockwise, in order to move the orifices 52 into or out of registration with the orifices 40 in the place 38. This arrangement facilitates adjustment of the split of the oxygen between the main jet flowing through the Laval nozzle 24 and the shroud passing through the passage 30 also as to obtain the optimum performance in metallurgical use.

Figure 4:
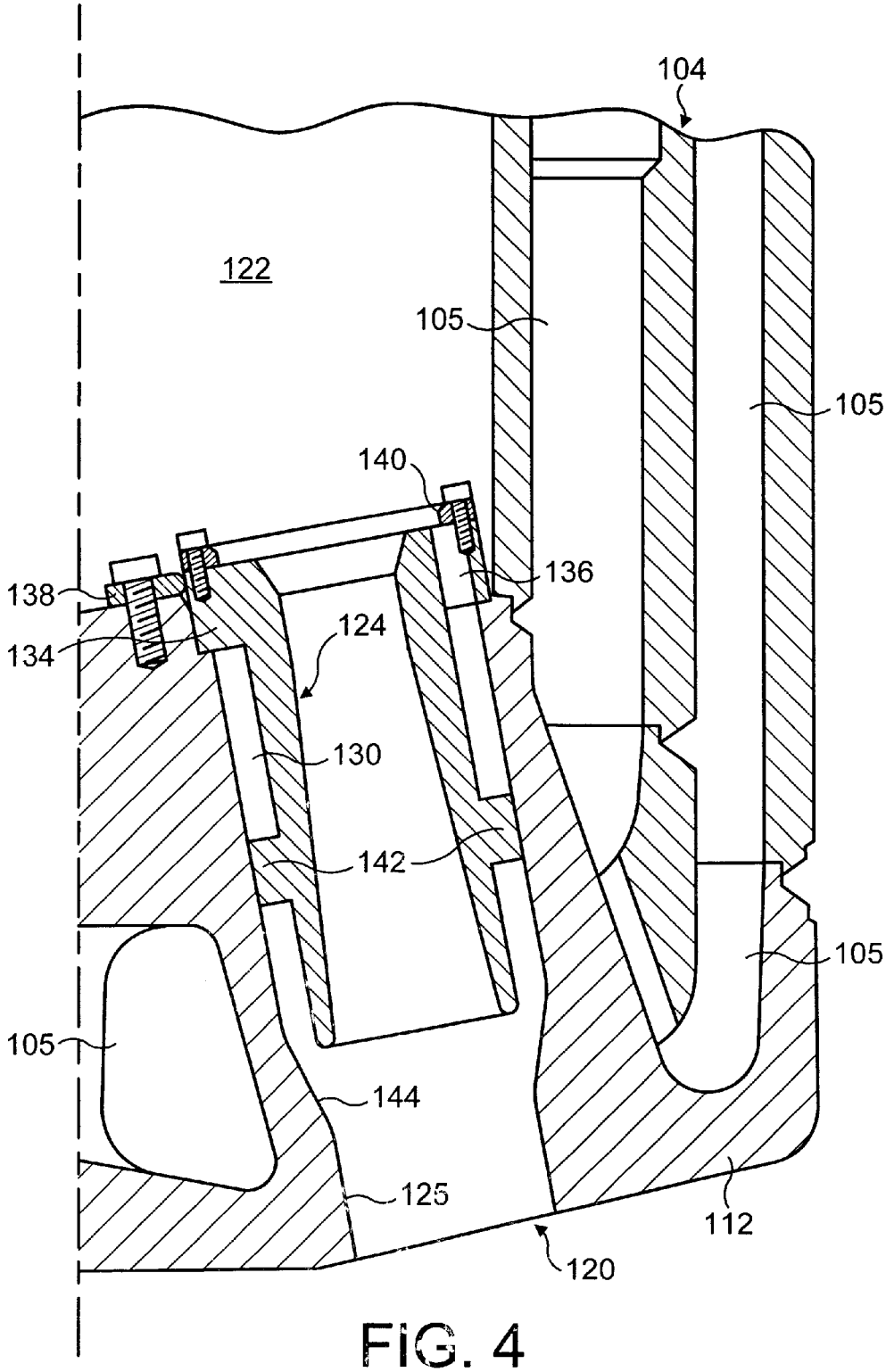
FIG. 4 is a cross sectional side elevation view of part of the head of another embodiment of a metallurgical lance according to the invention and having a different ejector from the lance shown in FIGS. 2 and 3.
Figure 5:
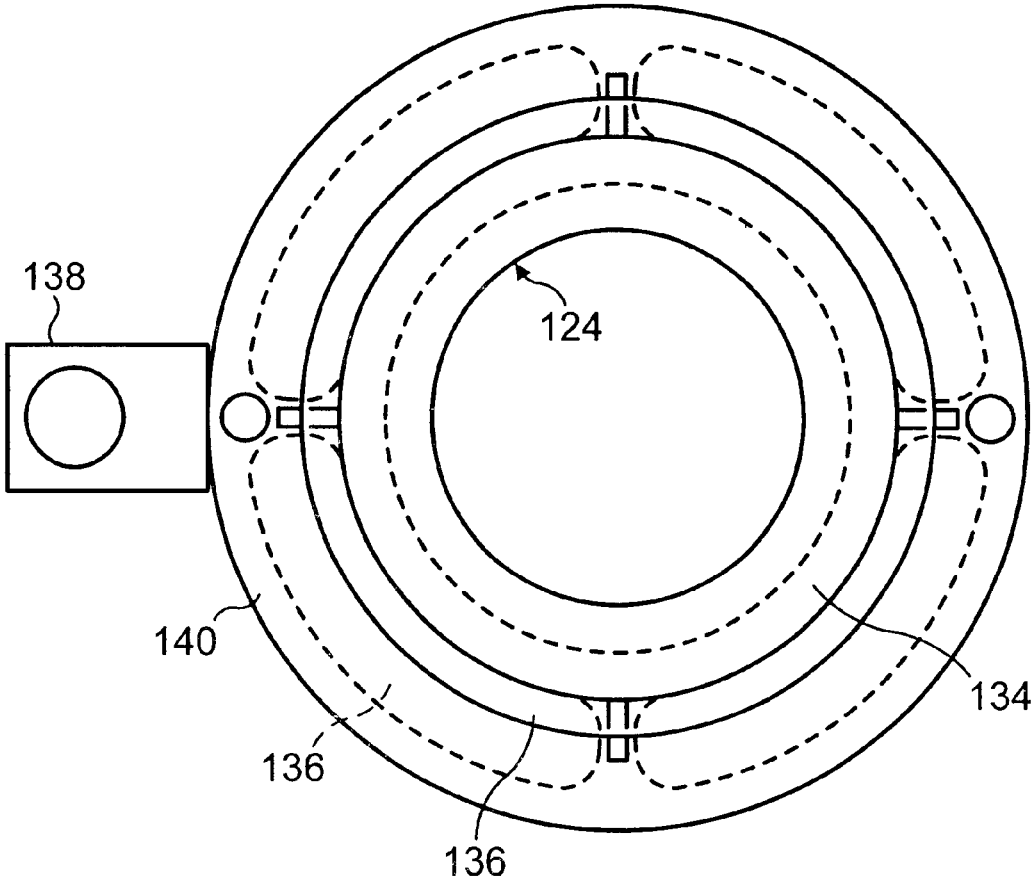
FIG. 5 is a view of the ejector shown in FIG. 4 from its proximal end.

A further embodiment of the lance and head is shown in FIGS. 4 and 5 of the accompanying drawings.

With reference to FIGS. 4 and 5, a lance 104 has a head 112. The head 112 has a plurality of ejectors 120 formed therein, of which only one is shown in FIG. 4. The lance 104 and head 112 are formed with passages 105 therein for the flow of cooling water. The head is preferably formed of metal having a high thermal conductivity, e.g. copper.

The ejector 120 communicates at its proximal end with a gas supply chamber 122 formed in the lance 104. The chamber 122 may be an oxygen passage formed in the lance 104.

The gas ejector 120 comprises a Laval nozzle 124 which is coaxial with a bore 125 in the head. The Laval nozzle 124 and the bore 125 define a shrouding gas passage 130. The proximal end of the Laval nozzle has an integral annular orifice member 134. As better shown in FIG. 5, the orifice member 134 has four circumferentially arranged arcuate slots 136 formed therethrough. The annular orifice member 134 makes a sealing engagement with the mouth of the bore 125 such that all the gas flow into the shrouding gas passage 130 is by way of the slots 136.

The Laval nozzle 124 has an arm 138 welded or otherwise connected to the orifice member 134. The arm 138 is fastened by means of a bolt to the proximal end of the head 112. The Laval nozzle 124 has a pair of lugs 142 which ensure that, when assembling the ejector 120, the Laval nozzle 124 is centred within the bore 125.

A solid annular plate 140 of the same outer diameter as the annular orifice member 134 engages the member 134 face to face and is bolted or otherwise secured thereto. The annulus of the plate 140 partially overlaps the slots 136. The degree of overlap therefore determines the size of the openings for the flow of gas into the shrouding gas passage 130, and therefore determines the mass flow ratio of the gas passing into the Laval nozzle 124 to that passing into the shrouding gas passage 130. If desired, the solid annular plate 140 may be detached from the nozzle 124 and one of different dimensions secured to the nozzle 124 in its stead so as to change this ratio. In a typical example, a set of plates 140 may be made, one dimensioned so that 10% of the total gas flow passes, in use, through the shrouding gas passage, a second dimension so that this percentage is 20% of the total gas flow, and a third so that the percentage is 30% of the total gas flow.

The Laval nozzle 124 terminates well within the bore 125. It is thus protected from splashes of metals in use of the lance 104.

In operation of the lance 104 to supply oxygen to a bath of molten metal, the oxygen supply pressure may be selected to be in the range of 10 to 15 bar so as to give an oxygen exit velocity from the Laval nozzle 124 of greater than Mach 2. The velocity of the oxygen through the shrouding gas passage 130 does not exceed sonic velocity and is usually less. The oxygen flow rate through the shrouding gas passage 130 is typically arranged to be from 5% to 30% of that through the Laval nozzle 124. The oxygen exiting the shrouding gas passage 130 forms a shroud for that leaving the Laval nozzle 124. The shroud limits the amount of gas mixing that occurs at the periphery of the oxygen jet from the Laval nozzle 124 in comparison with that which would occur were the shroud to be omitted and the oxygen jet to be surrounded by still air rather than by the oxygen shrouding gas flow. As a result, a relatively narrow jet of oxygen may be maintained over a longer distance of travel from the tip of the lance 104 compared with an unshrouded jet. In consequence, it is possible to obtain higher oxygen entry velocities into for example a bath or other volume of molten metal, or to position the lance further away from the surface of the molten metal without significant loss of the penetrative power of the jet. It is found that the amount of peripheral mixing of the jet with the shroud tends to decrease as the shrouding gas flow increases from 5% of that of the supersonic oxygen jet until a maximum is reached. Thereafter, further increases in the shrouding gas proportion tend to be counterproductive. The optimum shrouding gas proportion can readily be determined empirically.

Similarly to the metallurgical lances shown in FIGS. 2 and 3 of the drawings, that shown in FIGS. 4 and 5 can be made by modification to a conventional lance. The bore of each ejector of the conventional lance is reshaped, being widened for most of its extent, but typically being left unaltered at its distal end. A boring tool may be used. The boring makes it possible to insert a Laval nozzle 124 of suitable dimensions. The bore 125 is formed with a shoulder 144. The shoulder 144 has a shallow curvature. As a result, in use, shrouding gas tends to flow along the surface of the shoulder 144 by virtue of a Coanda effect. Therefore, downstream of the distal end of the Laval nozzle 124, the shrouding gas, in use, is not deflected towards the jet issuing from the Laval nozzle 124, but instead travels generally parallel to the jet. The mouth of the Laval nozzle 124 at its distal end is of smaller internal diameter than the mount of the bore 125 at the distal end of the head 112.

If the lance shown in FIGS. 4 and 5 is made by adapting a conventional lance, it may be operated such that each ejector has an unaltered main oxygen jet flow rate. As a result, taking into account the shrouding gas flow, the total oxygen flow through the lance is somewhat increased. There is therefore a need to increase the oxygen supply pressure so as to enable the additional oxygen flow to be provided. Alternatively, the total oxygen flow may remain unaltered, but this will have the effect of diminishing the central oxygen flow as some of the oxygen will be diverted to form the shroud.

Although the lances shown in the drawings have been described herein for introducing oxygen into molten metal, they may alternatively be used with a different gas.

It will be understood that the embodiments described herein are merely exemplary and that a person skilled in the art may make many variations and modifications without departing from the spirit and scope of the invention. All such modifications and variations are intended to be included within the scope of the invention as defined in the appended claims.

What is claimed is:

1. A metallurgical lance for introducing gas from above into a volume of molten metal in a vessel, the lance including a head having at least one gas ejector formed therein, wherein the ejector or at least one of the ejectors comprises: a Laval nozzle surrounded by a shrouding gas passage, both the Laval nozzle and the shrouding gas passage communicating at their proximal ends with a common gas supply chamber, wherein the shrouding gas passage communicates with the common gas supply chamber via a first annular member having first orifices therethrough.

2. The metallurgical lance according to claim 1, wherein the first annular member comprises a first orifice plate.

3. The metallurgical lance according to claim 1, wherein the first annular member is integral with the Laval nozzle.

4. The metallurgical lance according to claim 3, wherein the first orifices in the first annular member overlap a solid annular plate demountably attached to the proximal end of the Laval nozzle.

5. The metallurgical lance according to claim 3, wherein the first orifices in the first annular member comprise a plurality of arcuate slots.

6. The metallurgical lance according to claim 2, wherein the shrouding gas passage is defined by a sleeve coaxial with the Laval nozzle and the first orifice plate is demountably attached to the sleeve.

7. The metallurgical lance according to claim 6, further comprising means for varying a proportion of an annular area of the orifice plate that is open to the common gas supply chamber.

8. The metallurgical lance according to claim 7, wherein said varying means comprises a second orifice plate with second orifices therethrough, the second orifice plate being adjustable relative to the first orifice plate so as to move the second orifices of the second orifice plate into and out of registration with the first orifices of the first orifice plate.

9. A head for a metallurgical lance, comprising:

a Laval nozzle;

a gas passage shrouding the Laval nozzle;

a gas supply chamber in communication with the Laval nozzle and the gas passage; and a plate having a plurality of orifices therethrough, the plate disposed at the gas passage for controlling communication between the gas supply chamber and the gas passage.

10. The head according to claim 9, wherein the plate is integral with the Laval nozzle.

* * * * *